United States Patent [19]

Reinert

[11] 4,165,543

[45] Aug. 28, 1979

[54] SUSPENDED MOTOR LIFTED SWIMMING POOL COVER

[76] Inventor: George R. Reinert, R.D. #1, Bethlehem, Pa. 18017

[21] Appl. No.: 890,697

[22] Filed: Mar. 27, 1978

[51] Int. Cl.[2] ..... E04H 3/19; B66C 23/62

[52] U.S. Cl. ..... 4/172.12; 4/172.14; 254/178

[58] Field of Search ..... 4/172.11, 172.12, 172.13, 4/172.14, 185.6, 162, 251, 172; 254/144, 167, 178

[56] References Cited

U.S. PATENT DOCUMENTS

| | | | |
|---|---|---|---|
| 2,895,143 | 7/1959 | Seitz | 4/172.14 |
| 3,021,530 | 2/1962 | Sears | 4/172.11 |
| 3,091,777 | 6/1963 | Pearlson | 4/172.13 |
| 3,241,157 | 3/1966 | Baker et al. | 4/172.11 |
| 3,349,411 | 10/1967 | Eaton | 4/185 L |
| 3,534,412 | 10/1970 | Crook | 4/172.12 |
| 3,615,065 | 10/1971 | Elliott | 254/178 X |
| 3,895,400 | 7/1975 | Kekey | 4/287 X |
| 4,048,678 | 9/1977 | Chillino | 4/172.12 |
| 4,094,021 | 6/1978 | Rapp | 4/172.12 |
| 4,109,325 | 8/1978 | Shuff | 4/172.12 |

*Primary Examiner*—Stuart S. Levy
*Attorney, Agent, or Firm*—Clarence A. O'Brien; Harvey B. Jacobson

[57] ABSTRACT

A supportive frame of crossed, intersecting and interconnected frame members is provided with the frame being horizontally disposed and of a plane shape and area conforming to the plane shape and area of an associated swimming pool. The supportive frame includes cover panel structure supported therefrom and is suspended over the associated swimming pool by suspension cables and the cover may be lowered downwardly over the pool by the cables. The cover includes peripheral notches formed therein for receiving a diving board and pool steps and the cables supporting the cover are spaced along the latter in one direction thereof whereby guide pulleys anchored above the cover may have the cables passed thereover and elevated winding drums spaced along one marginal edge of the cover in the aforementioned direction may have the cables wound thereon for the purpose of raising and lowering the cover relative to the pool upon selective rotation of the winding drums.

6 Claims, 5 Drawing Figures

SUSPENDED MOTOR LIFTED SWIMMING POOL COVER

BACKGROUND OF THE INVENTION

There are many instances when a cover for a swimming pool is desirable. Covers are desirable for indoor swimming pools (particularly in cool climates) whereby the evaporation of heated swimming pool water in an enclosure when the swimming pool is not in use may be prevented. By eliminating the evaporation of water from an enclosed swimming pool humidity within the pool enclosure may be more readily controlled and the problem of condensation forming on the inner surfaces of the enclosure is greatly reduced. Further, covers for outdoor pools prevent the accumulation of debris in the pools when they are not in use and also enable swimming in the outdoor pools when cool weather ordinarily would not permit swimming. Swimming may be carried out in an outdoor pool in cool weather when the cover of the pool is raised approximately two feet above the pool. In this manner, as long as the pool is not subject to surface winds, the heat of water within the pool is confined, at least a great extent, beneath the cover.

Further, by providing a cover for an outdoor pool, the pool may be shaded when in use during extremely hot weather and covered when not in use to reduce the amount of debris which may accumulate in the pool and the cost of operating and servicing filtering equipment associated with the pool is greatly reduced. Further, by providing a cover for an enclosed pool, considerable savings of the cost of operation of the pool and the pool enclosure may be realized by eliminating the necessity of installing and operating humidity controlling equipment for the pool enclosure.

Examples of previously known forms of pool covers are disclosed in U.S. Pat. Nos. 3,241,157, 3,566,420, 3,832,741, 3,895,400, 3,916,457 and 4,000,527.

BRIEF DESCRIPTION OF THE INVENTION

The cover of the instant invention includes a horizontal framework over which a 15 mil polyester reinforced vinyl panel is secured and the frame of the cover includes 12 suspension points to which the free ends of 12 cables are secured. Pulleys, supported in elevated position above the cover have the 12 cables passed thereover and an elevated supporting extending along one marginal edge of the cover rotatably journals a pair of shafts upon which 12 winding drums are mounted. The ends of the cables remote from the cover are wound about the winding drums and a pair of simultaneously actuable electric motors are drivingly connected to the shafts for rotation thereof in selected directions. In addition, a plurality of coiled commerical garage door springs are operatively connected to the shafts for counterbalancing at least a major portion of the weight of the cover.

The main object of this invention is to provide a pool cover assembly which may be adapted for use in providing a vertically retractable pool cover for pools of different sizes and shapes.

Another object of this invention is to provide a pool cover suspended in a manner whereby the associated swimming pool may be safely used when the cover is in a partially raised position.

Still another object of this invention is to provide a pool cover assembly which may be utilized effectively in operative association with an enclosed pool in order to substantially eliminate the evaporation of water from the associated pool when the pool is not in use.

Another object of this invention is to provide a pool cover assembly which may be readily constructed for use in conjunction with pools of different sizes and shapes.

A final object of this invention to be specifically enumerated herein is to provide a pool cover assembly in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
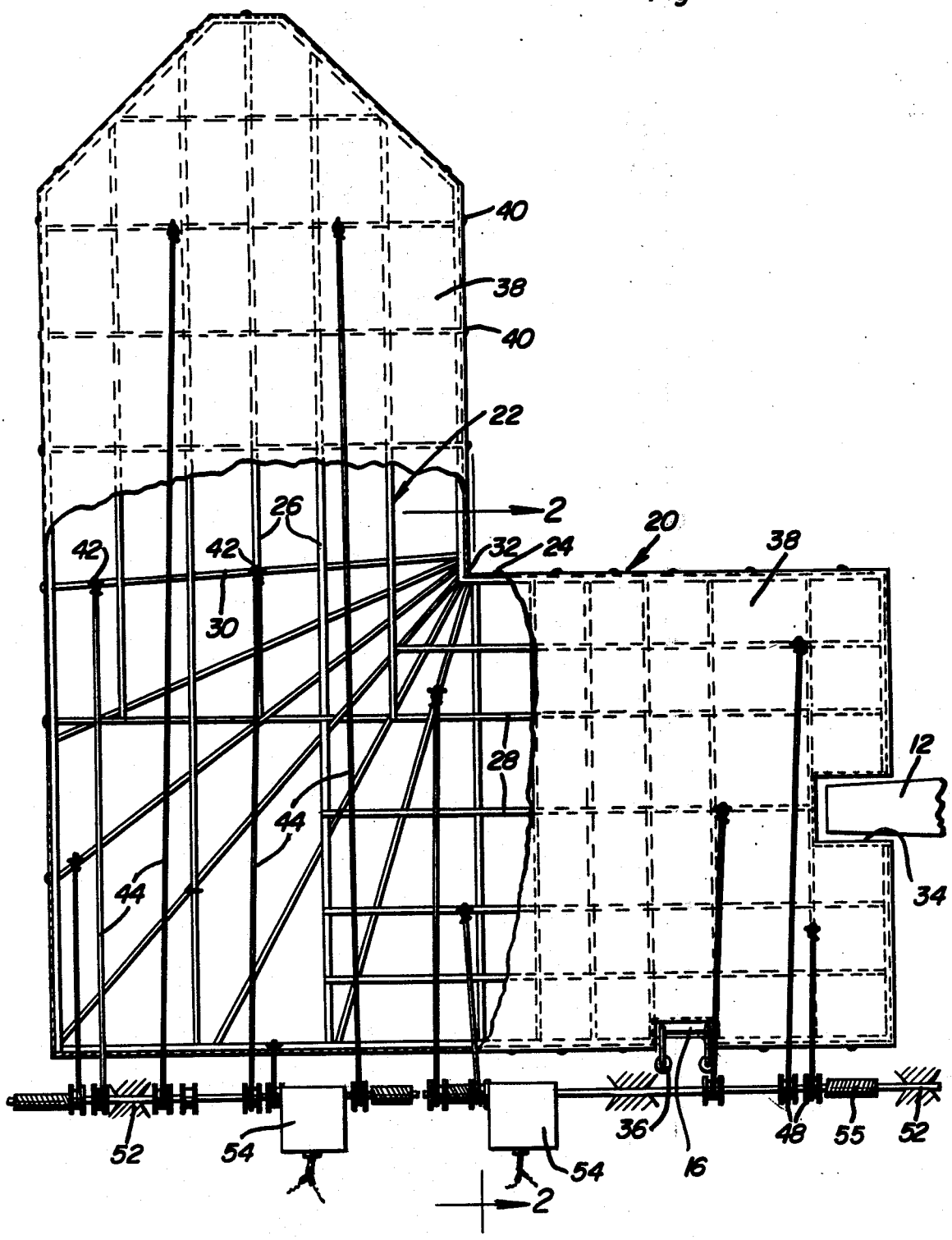
FIG. 1 is a top plan view of a pool cover constructed in accordance with the present invention and with portions of the cover being broken away and illustrated in horizontal section.
Figure 2:
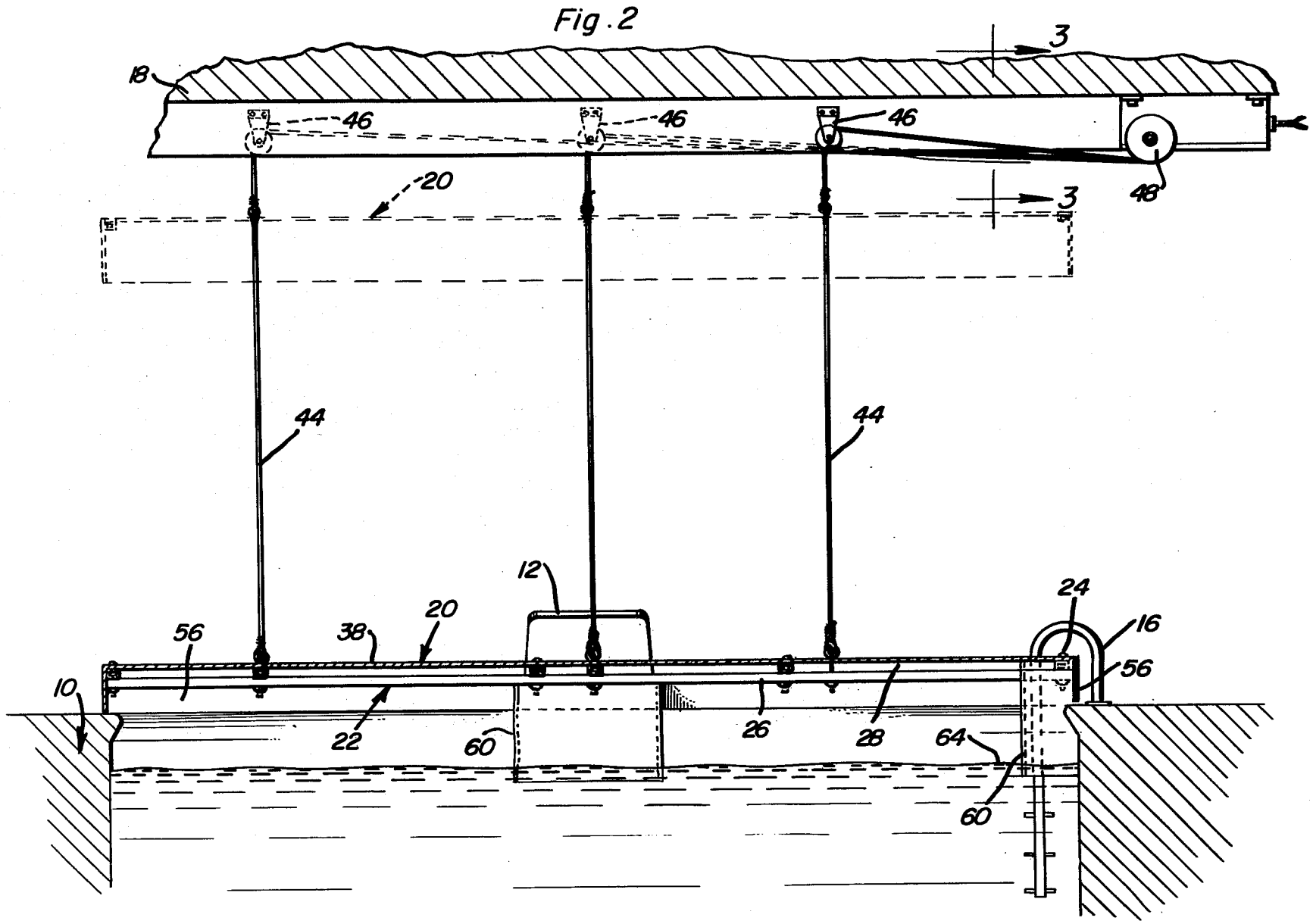
FIG. 2 is an enlarged, fragmentary, vertical sectional view taken substantially upon the plane indicated by the section line 2—2 of FIG. 1.
Figure 3:
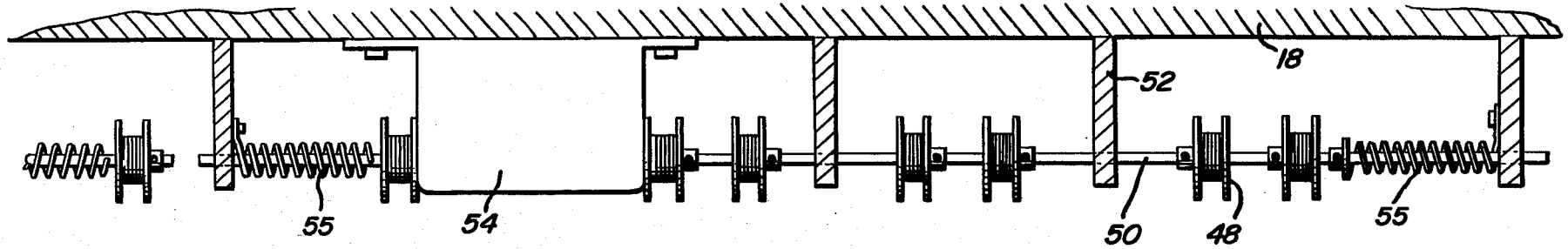
FIG. 3 is an enlarged, fragmentary, vertical sectional view taken substantially upon the plane indicated by the section line 3—3 of FIG. 2.
Figure 5:
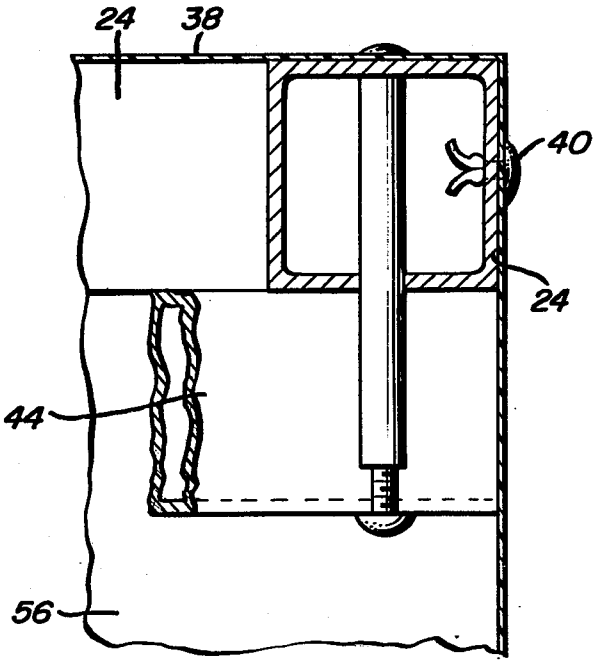
FIG. 5 is an enlarged, fragmentary, vertical sectional view of one peripheral portion of the pool cover.
Figure 4:
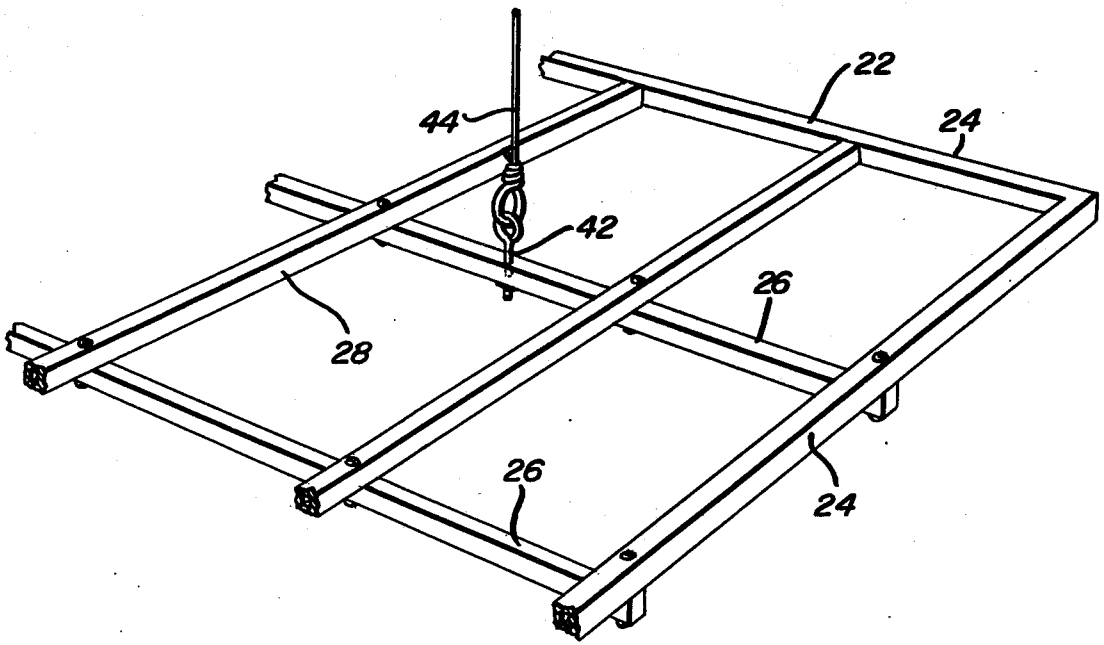
FIG. 4 is an enlarged, fragmentary, perspective view of a portion of the frame of the cover assembly.

Referring now more specifically to the drawings, the numeral 10 generally designates a swimming pool which is generally L-shaped. The pool 10 includes a diving board 12 at the free end of the short leg thereof and pool steps 16 at one side adjacent the diving board 12. The pool 10 is disposed within an enclosure including a roof structure 18 and a cover constructed in accordance with the present invention and referred to in general by the reference numeral 20 is operatively associated with the pool 10.

The cover 20 includes a frame referred to in general by the reference numeral 22 and the frame includes peripheral members 24 extending peripherally thereabout, first parallel cross members 26 extending between opposing peripheral members 24, second parallel cross members 28 disposed at right angles relative to the cross members 26 extending between opposing peripheral members 24 and radiating members 30 radiating outwardly from the inside corner portion 32 of the cover 20. The members 26 and 28 generally parallel the long and short legs of the L-shaped cover 20 and the members 26 underlie the members 28 while the members 30 underlie the members 26 and 28. The members 26, 28 and 30 are interconnected relative to each other and the peripheral members 24 and the cover 20 has a first notch 34 formed therein registered with the diving board 12 and a second notch 36 formed therein registered with the steps 16.

The frame 22 is covered by a 15 mil polyester reinforced vinyl panel 38 secured to the frame 12 by means of peripherally spaced fasteners 40 and the cover 20 includes 12 suspension eyes 42 secured thereto and extending upwardly through the panel 38. One set of ends of 12 suspension cables 44 are anchored relative to the suspension eyes 42 and the ceiling structure 18 supports 12 pulley structures 46 therefrom in vertical spaced relation relative to the eyes 42 and over which the cables 44 pass. The ends of the cables remote from the suspension eyes 42 are wound on winding drums 48 mounted on a pair of aligned shafts 50 journaled from suspension supports 52 secured to the ceiling structure 18. The shafts 50 extend along the marginal edge of the pool 10 upon which the steps 16 are mounted and each of the shafts 50 has a FL201-type C heavy commercial motor 54 drivingly connected thereto. The motors 54 are marketed by the Overhead Door Co. and are of the reversible type. Further, each motor 54 includes a solenoid actuated brake operable to brake the motor 54 when the supply of current to the motor 54 is interrupted.

Five of the drums 48 are mounted on one of the shafts 50 and seven of the drums 48 are mounted on the other shaft 50. In addition, each of the shafts 50 has a pair of coiled torsion springs 55 connected thereto at one pair of corresponding ends and to an adjacent suspension support 52 at their other ends. The springs 55 serve to counterbalance at least a substantial portion of the weight of the cover and the motors 54 are electrically connected for simultaneous operation. In addition, the cover 20 includes automatic traverse stops (not shown) adjacent the pool 10 and the ceiling structure 18 whereby lowering of the cover 20 toward the pool 10 and raising of the cover 20 toward the ceiling structure 18 will automatically be terminated as desired.

The eyes 42 are evenly distributed over the plan area of the cover 20 and the manual controls (not shown) for the motors 54 are to be located in a position where they may not be readily operated by children. The controls may be utilized to raise and lower the cover 20 as desired and the cover 20 may be raised only slightly above the pool 10, it desired, in order to prevent heat loss from the pool.

If the cover 20 is to be utilized in conjunction with an outdoor pool, suitable supports for the pulleys 46 and shafts 50 and motors 54 must be provided. However, these supports need not be excessively strong inasmuch as the cover, including the frame 22, is of lightweight construction and weighs only approximately two-thirds of a pound per square foot of plan area.

The panel 38 includes depending peripheral skirt portions 56 extending peripherally about and projecting approximately three and one-half inches below the frame 22 for engagement with the deck 58 extending about the pool 10 and those portions of the panel 38 extending peripherally about the notches 34 and 36 include depending skirt portions 60 extending ten inches below the frame 22 down into the water 64 within the pool 10. In this manner, when the cover rests upon the upper surfaces of the deck surrounding the pool 10, the skirt portions 60 will form a seal with the water adjacent the steps 16 and the diving board 12 in order to reduce heat loss and water vapor loss beneath the cover 20.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a swimming pool of a given size and shape, overhead support structure disposed above said pool and along one marginal portion thereof, a lightweight cover for said pool including a horizontal skeletal frame of substantially the same shape but of slightly larger size than said pool and including crossed and interconnected frame members and peripheral frame portions extending about the periphery of said frame, a lightweight panel secured over said frame, said cover including a plurality of horizontally spaced apart anchor members secured to said frame and projecting upwardly through said panel member, a plurality of guide means supported from said overhead support structure vertically above said anchor members, a plurality of elongated flexible tension members having one set of ends anchored relative to said anchor members and midportions thereof guidingly engaged over said guide means, winding drum means journalled from the portion of said overhead support structure disposed along said one pool marginal portion and to which the other set of ends of said tension are anchored for winding thereon and unwinding therefrom, said pool including a diving board and pool steps projecting inwardly from spaced marginal portions of said pool, the marginal portions of said cover corresponding to said spaced marginal portions of said pool defining outwardly opening notches formed therein upwardly through which said diving board and steps are receivable when said cover is lowered into position closely overlying said pool, said notch defining marginal portions of said cover including depending skirt portions projectable downwardly below the water level of said pool when said cover is in a lowered position over said pool.

2. The combination of claim 1 wherein said skirt portions comprise marginal portions of said panel member.

3. The combination of claim 1 wherein said portion of said overhead support structure extending along said one marginal portion of said pool has horizontal shaft means journalled therefrom and extending therealong, said winding drum means including a plurality of winding drums spaced along and secured to said shaft means for rotation therewith, and reversible motor means supported from said support structure and drivingly connected to said shaft means, said other set of ends of said tension members being anchored to said winding drums.

4. The combination of claim 3 wherein said shaft means includes a pair of shafts journalled from said overhead support structure and said motor means includes a pair of simultaneously actuatable reversible motors drivingly connected to said shafts.

5. In combination with a swimming pool of a given size and shape, overhead support structure disposed above said pool and along one marginal portion thereof, a lightweight cover for said pool including a horizontal skeletal frame of substantially the same shape but of slightly larger size than said pool and including crossed and interconnected frame members and peripheral frame portions extending about the periphery of said frame, a lightweight panel member secured over said frame, said cover including a plurality of horizontally spaced apart anchor members secured to said frame and projecting upwardly through said panel member, a plurality of guide means supported from said overhead support structure vertically above said anchor members, a plurality of elongated flexible tension members having one set of ends anchored relative to said anchor members and midportions thereof guidingly engaged over said guide means, winding drum means journalled from the portion of said overhead support structure disposed along said one pool marginal portion and to which the other set of ends of said tension are anchored for winding thereon and unwinding therefrom, said portion of said overhead support structure extending along said one marginal portion of said pool having horizontal shaft means journalled therefrom and extending therealong, said winding drum means including a plurality of winding drums spaced along and secured to said shaft means for rotation therewith, reversible motor means supported from said support structure and drivingly connected to said shaft means, said other set of ends of said tension members being anchored to said winding drums, said shaft means including a pair of shafts journalled from said overhead support structure and said motor means including a pair of simultaneously actuatable reversible motors drivingly connected to said shafts, coiled torsion springs disposed about said shafts and connected between the latter and said overhead support structure and at least partially counterbalancing the weight of said cover, said pool including a diving board and pool steps projecting inwardly from spaced marginal portions of said pool, the marginal portions of said cover corresponding to said spaced marginal portions of said pool defining outwardly opening notches formed therein upwardly through which said diving board and steps are receivable when said cover is lowered into position closely overlying said pool, said notch defining marginal portions of said cover including depending skirt portions projectable downwardly below the water level of said pool when said cover is in a lowered position over said pool.

6. The combination of claim 5 wherein said skirt portions comprise marginal portions of said panel member.

* * * * *